US008177088B1

(12) United States Patent
Williams

(10) Patent No.: US 8,177,088 B1
(45) Date of Patent: May 15, 2012

(54) ADJUSTABLE SEALING DEVICE FOR STORAGE CONTAINERS

(76) Inventor: Rebecca L. Williams, Seattle, WA (US)

( * ) Notice: Subject to any disclaimer, the term of this patent is extended or adjusted under 35 U.S.C. 154(b) by 461 days.

(21) Appl. No.: 12/386,228

(22) Filed: Apr. 15, 2009

Related U.S. Application Data

(60) Provisional application No. 61/045,455, filed on Apr. 16, 2008.

(51) Int. Cl.
*B01D 35/00* (2006.01)
*B65D 51/16* (2006.01)

(52) U.S. Cl. ..... 220/203.21; 220/203.19; 220/203.07; 220/89.1

(58) Field of Classification Search ..... 215/266, 215/228, 260, 270; 220/89.1, 554, 529, 578, 220/216
See application file for complete search history.

(56) References Cited

U.S. PATENT DOCUMENTS

| | | | | | |
|---|---|---|---|---|---|
| 133,883 | A | * | 12/1872 | Parkhurst | 215/264 |
| 2,726,012 | A | * | 12/1955 | Jensen | 220/580 |
| 3,974,758 | A | | 8/1976 | Stone, Jr. | |
| 4,362,095 | A | | 12/1982 | Wheatley | |
| 4,741,448 | A | * | 5/1988 | Alley et al. | 215/266 |
| 4,785,723 | A | * | 11/1988 | Sheen | 99/279 |
| 4,874,108 | A | | 10/1989 | Valasek | |
| 5,275,298 | A | * | 1/1994 | Holley et al. | 215/11.4 |
| 5,370,266 | A | * | 12/1994 | Woodruff | 222/1 |
| 5,402,908 | A | | 4/1995 | Warden et al. | |
| 5,469,979 | A | | 11/1995 | Chiou | |
| 6,131,753 | A | | 10/2000 | Lynch | |
| 6,945,014 | B1 | | 9/2005 | Quann | |
| 7,121,436 | B2 | * | 10/2006 | Lee et al. | 222/477 |
| 7,159,736 | B1 | * | 1/2007 | Torelli | 220/578 |
| 7,494,025 | B2 | * | 2/2009 | Porter | 220/580 |
| 2007/0224054 | A1 | | 9/2007 | Grande | |

* cited by examiner

*Primary Examiner* — J. Gregory Pickett
*Assistant Examiner* — Ernesto Grano
(74) *Attorney, Agent, or Firm* — Gregory W. Moravan

(57) ABSTRACT

An adjustable sealing device for a storage container is disclosed that has a compressible sealing ball to provide a seal with the inner surface of containers having a variety of sizes and shapes. The device's valve ball for its vent is normally biased closed by a tensioner, and is selectively opened by a flexible lead. The lead passes through a container lid and compression washer(s) located between the sealing ball and lid. To insert the sealing ball into the container the lead is tensioned, to orient the longitudinal axis of the washer(s) perpendicular to the lid and sealing ball, so that pressure on the lid will be transmitted to the sealing ball through the compression washer(s). Releasing the lead's tension enables the lid to be placed on the container, and the lead and compression washers to be compactly draped over the sealing ball inside of the container.

16 Claims, 7 Drawing Sheets

ADJUSTABLE SEALING DEVICE FOR STORAGE CONTAINERS

CROSS-REFERENCE TO RELATED APPLICATIONS

This application claims the benefit under 35 U.S.C. §119 (e) of U.S. Provisional Application No. 61/045,455, filed Apr. 16, 2008. Under 37 CFR 1.57 the forgoing parent Application is hereby incorporated by reference in this present Application.

STATEMENT REGARDING FEDERALLY SPONSORED RESEARCH OR DEVELOPMENT

The invention was not made by an agency of the United States Government or under a contract with an agency of the United States Government.

DETAILED DESCRIPTION OF THE INVENTION

Referring now to the Figures, it is desirable to store various products 18 in a sealed storage container 12 in order to increase the shelf life and to maintain the freshness, taste and potency of the stored products 18 by helping to prevent air from reaching the stored products 18, and by helping to prevent volatile components of the stored products 18 from escaping from the stored products 18.

By way of example, the adjustable sealing device 10 will be described as being used with a storage container 12 in which the stored product is ground or whole bean coffee 18.

Coffee 18 is generally distributed in a sealed distribution container, such as a bag or can, in order to increase its shelf life and maintain its freshness, taste and potency. However, once the distribution container is opened and some of the coffee 18 is removed by the user, the remaining coffee 18 is exposed to an ever increasing volume of air within the distribution container as more and more of the coffee 18 is removed; with the last remaining portion of coffee 18 ending up being stored in a distribution container that is predominantly full of air. As a result, the shelf life, freshness, taste and potency of the remaining coffee 18 tends to decrease over time due to an ever-increasing exposure of the coffee 18 to air, and due to a continuing loss of volatile components from the coffee 18 into the air.

Figure 1:
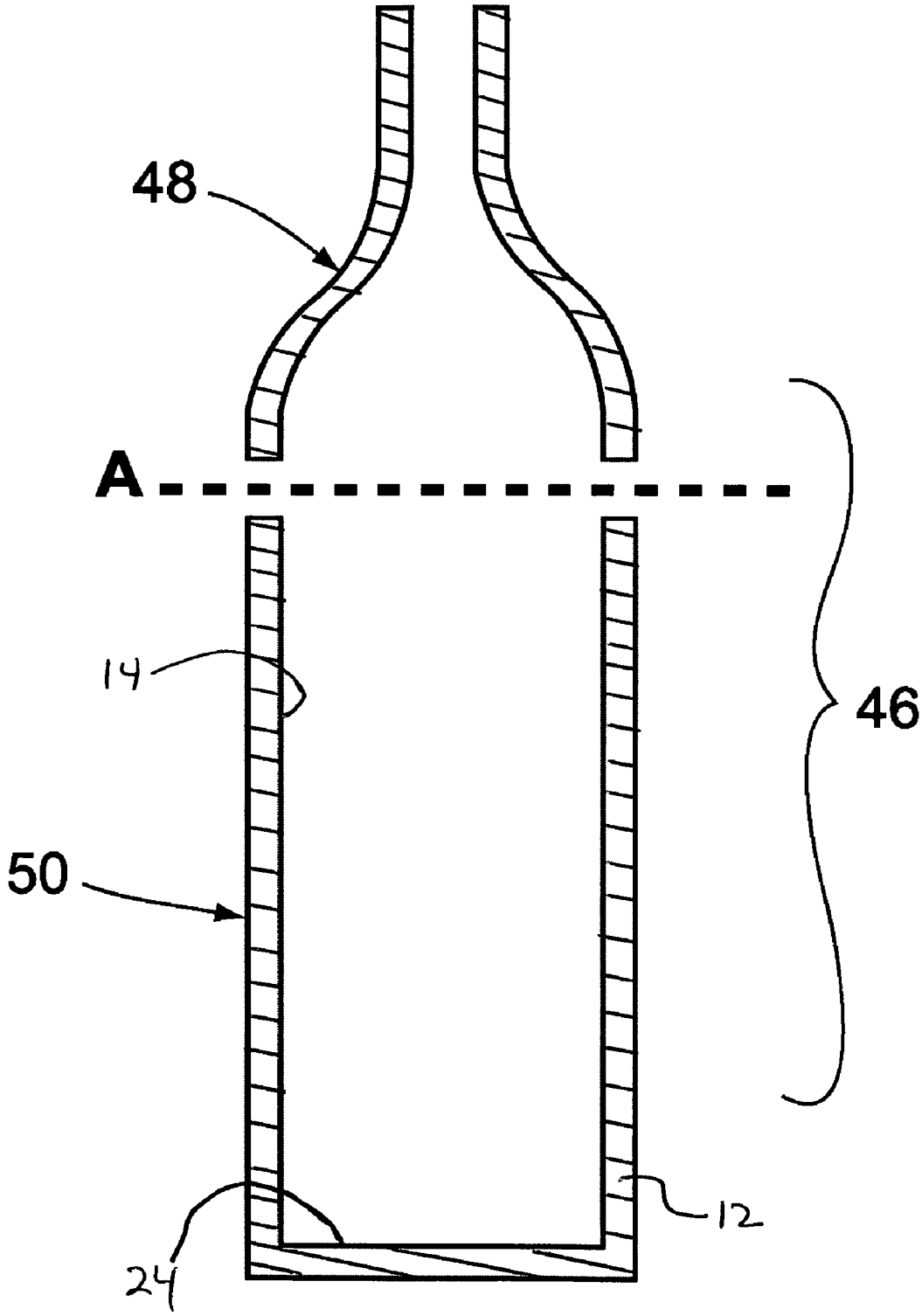
FIG. 1 is a cross-sectional view of a bottle 46 showing its neck 48 removed from its barrel 50 to provide recycled storage container 12.

The adjustable sealing device 10 may be used with any suitable storage container 12 having at least relatively stiff sides. For example, as seen in FIG. 1, a storage container 12 may be made by cutting a bottle 46 along line A, leaving a barrel 50 which may form the storage container 12. Alternatively, any suitable storage container 12 may be purchased ready-made. Although the storage container 12 is illustrated by way of example as having a circular inner cross-sectional configuration, it may have any other geometric or non-geometric inner cross-sectional configuration having one or more flat or curved sides, or any combination of flat and curved sides. The inner cross-sectional configuration of a storage container 12 is defined to be the cross-sectional configuration of the storage container 12 taken on a plane that is perpendicular to the central longitudinal axis of the storage container 12.

Generally, the coffee 18 would be removed from the distribution container in which it was purchased, and then placed into the storage container 12. However, as an alternative, it is possible that the coffee 18 may be sold in a suitable storage container 12.

Figure 6:
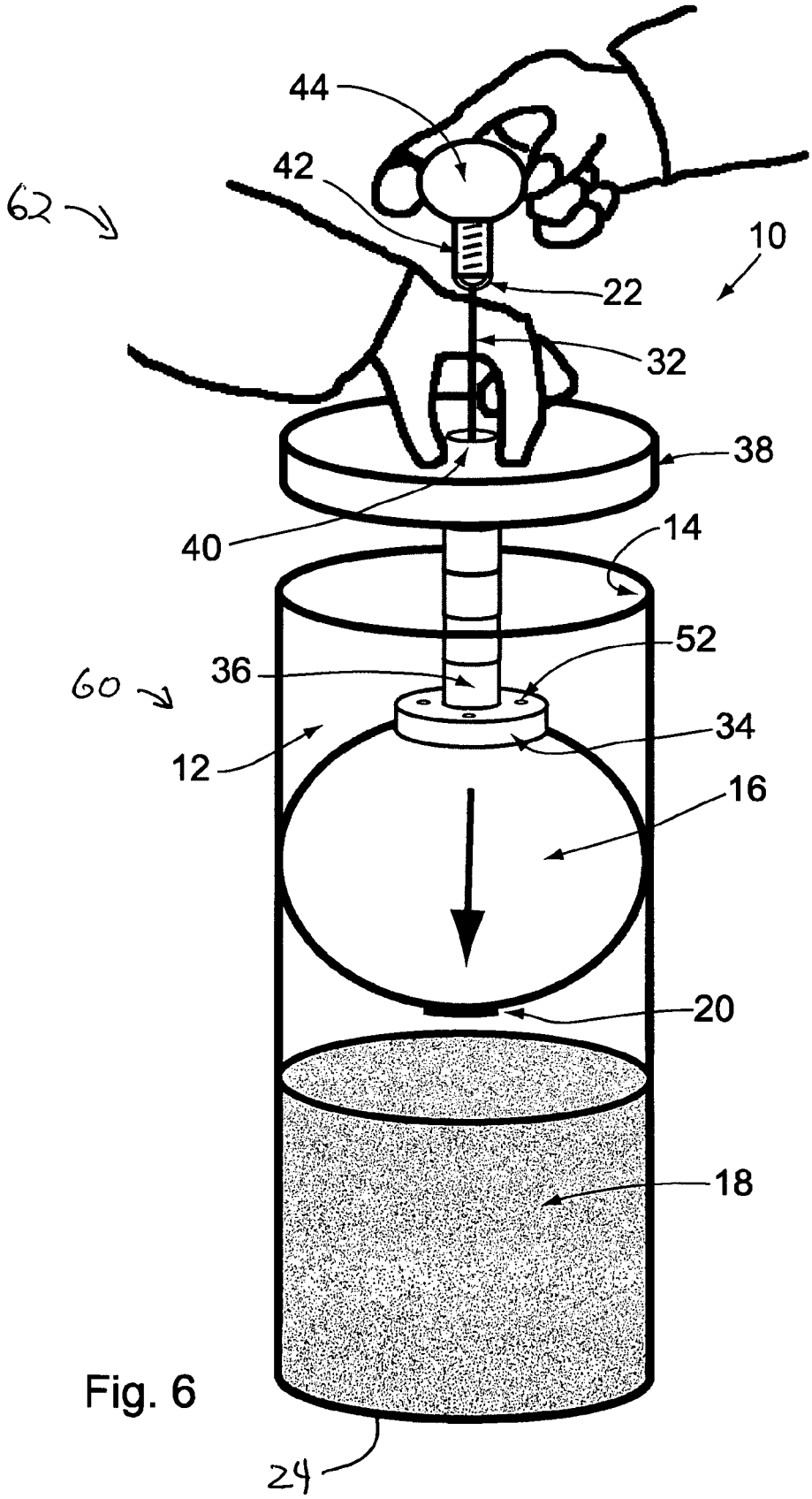
FIG. 6 is a perspective view of the adjustable sealing device 10 being inserted into a storage container 12.
Figure 7:
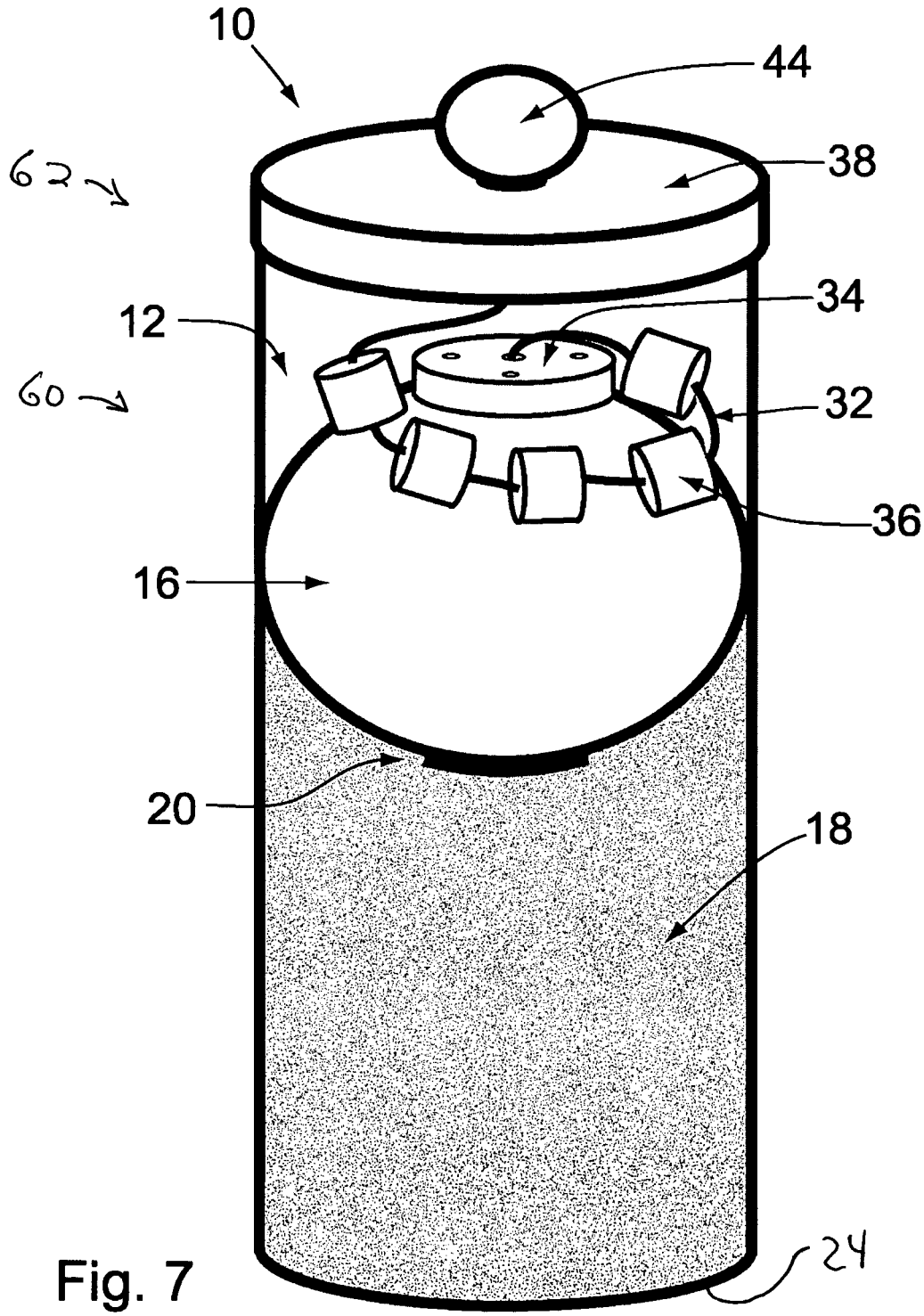
FIG. 7 is a perspective view of the adjustable sealing device 10 installed in a storage container 12.
Figure 8:
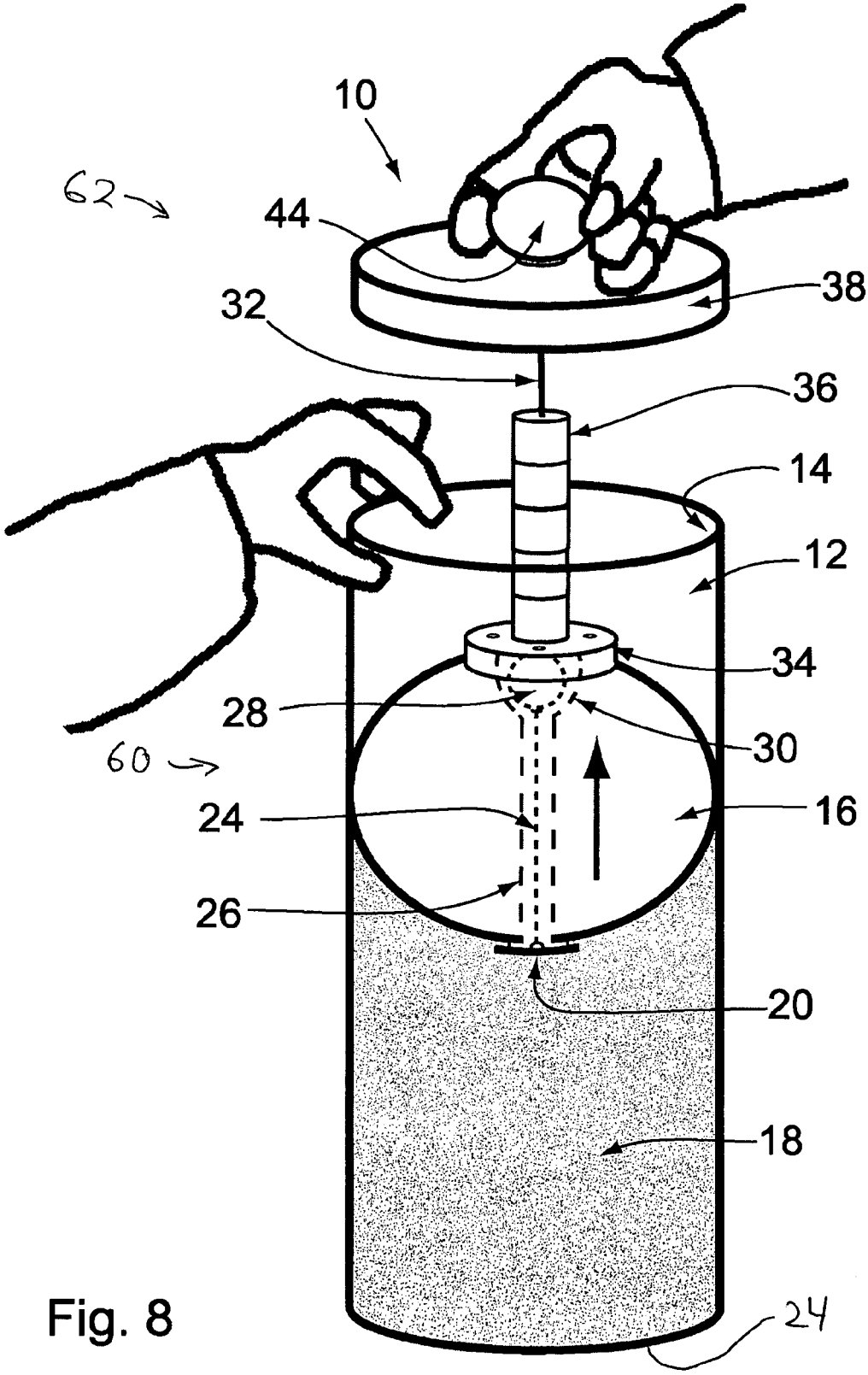
FIG. 8 is a perspective view of the adjustable sealing device 10 being removed from a storage container 12.

As best seen in FIGS. 6-8, the adjustable sealing device 10 may comprise a seal and valve assembly 60 and an insertion/removal assembly 62. As an alternative, the adjustable sealing device 10 may further comprise the storage container 12.

As seen in the Figures, the seal and valve assembly 60 may comprise any suitable sealing ball 16, any suitable vent 20, and any suitable valve 64 for the vent 20 that may be selectively opened and closed by the user or by any compressed air within the storage container 12.

The size and shape of the sealing ball 16, and the material from which it is at least partially made, may be selected to enable the sealing ball 16 to be operable to provide a seal between a peripheral sealing portion of its outer surface and a corresponding portion of the inner surface 14 of the storage container 12. The peripheral sealing portion of the sealing ball 16 is defined as that portion of the sealing ball 16 that makes contact with the container 12's inner surface 14 when the sealing ball 16 is located within the container 12.

The peripheral sealing portion of the sealing ball 16 may be made from any suitable smooth, resilient material that is operable to provide a seal with a corresponding portion of the inner surface 14 of the storage container 12. For example, suitable materials may be resilient rubber, plastic, or closed cell foam material. The entire sealing ball 16 may be made from a resilient material. Alternatively, only the peripheral sealing portion may be made from a resilient material, with the remainder of the sealing ball 16 being made from any other suitable material.

In general, the uncompressed size of the uncompressed peripheral sealing portion of the sealing ball 16 may be selected to be at least slightly larger than the inner size of the storage container 12. The uncompressed size of the uncompressed peripheral sealing portion of the sealing ball 16 is defined to be the cross-sectional area of the uncompressed peripheral sealing portion. The inner size of a storage container 12 is defined to be the cross-sectional area of the storage container 12 taken on a plane that is perpendicular to the central longitudinal axis of the storage container 12.

By way of example, if the sealing ball 16 was spherical, and if the storage container 12 had a cylindrical inner cross-sectional configuration, then the sealing ball 16 may be selected to have a peripheral sealing portion that has an uncompressed size that is at least slightly larger than the inner size of the cylindrical storage container 12. Although the sealing ball 16 is illustrated as being spherical, the sealing ball 16 may have any other suitable shape, such as cylindrical or football shaped.

In order that one sealing ball 16 may be operable to be used with a variety of different storage containers 12 that have a variety of different inner sizes, the sealing ball 16 may be made, wholly or in part, from a material that is very resilient and compressible. For example, the inner sizes of the container 12 may fall in the ranges of from about 50% to about 59% of the uncompressed size of the peripheral sealing portion of the sealing ball 16, from about 60% to about 69% of the uncompressed size of the peripheral sealing portion of the sealing ball 16, from about 70% to about 79% of the uncompressed size of the peripheral sealing portion of the sealing ball 16, from about 80% to about 89% of the uncompressed size of the peripheral sealing portion of the sealing ball 16, or from about 90% to 99% of the uncompressed size of the peripheral sealing portion of the sealing ball 16.

For example, if such a sealing ball 16 was spherical and its peripheral sealing portion had an uncompressed circular diameter of six inches, then it may be used with cylindrical storage containers having any of a variety of smaller diameters, such as from three inches to almost six inches.

The uncompressed peripheral sealing portion of the sealing ball 16 may be selected to have a cross-sectional configuration that is at least generally the same as that of the inner cross-sectional configuration of the container 12.

However, if at least the peripheral sealing portion of the sealing ball 16 is made from a material that is resilient and compressible, then such a sealing ball 16 may be used with storage containers 12 that have an inner cross-sectional configuration that is different from the corresponding cross-sectional configuration of the uncompressed peripheral sealing portion of the sealing ball 16. For example, a spherical sealing ball 16 that is made from a very compressible resilient material may be used with a storage container 12 that has a non-circular inner cross-sectional configuration, such as an oval, square or rectangular cross-sectional configuration.

Figure 2:
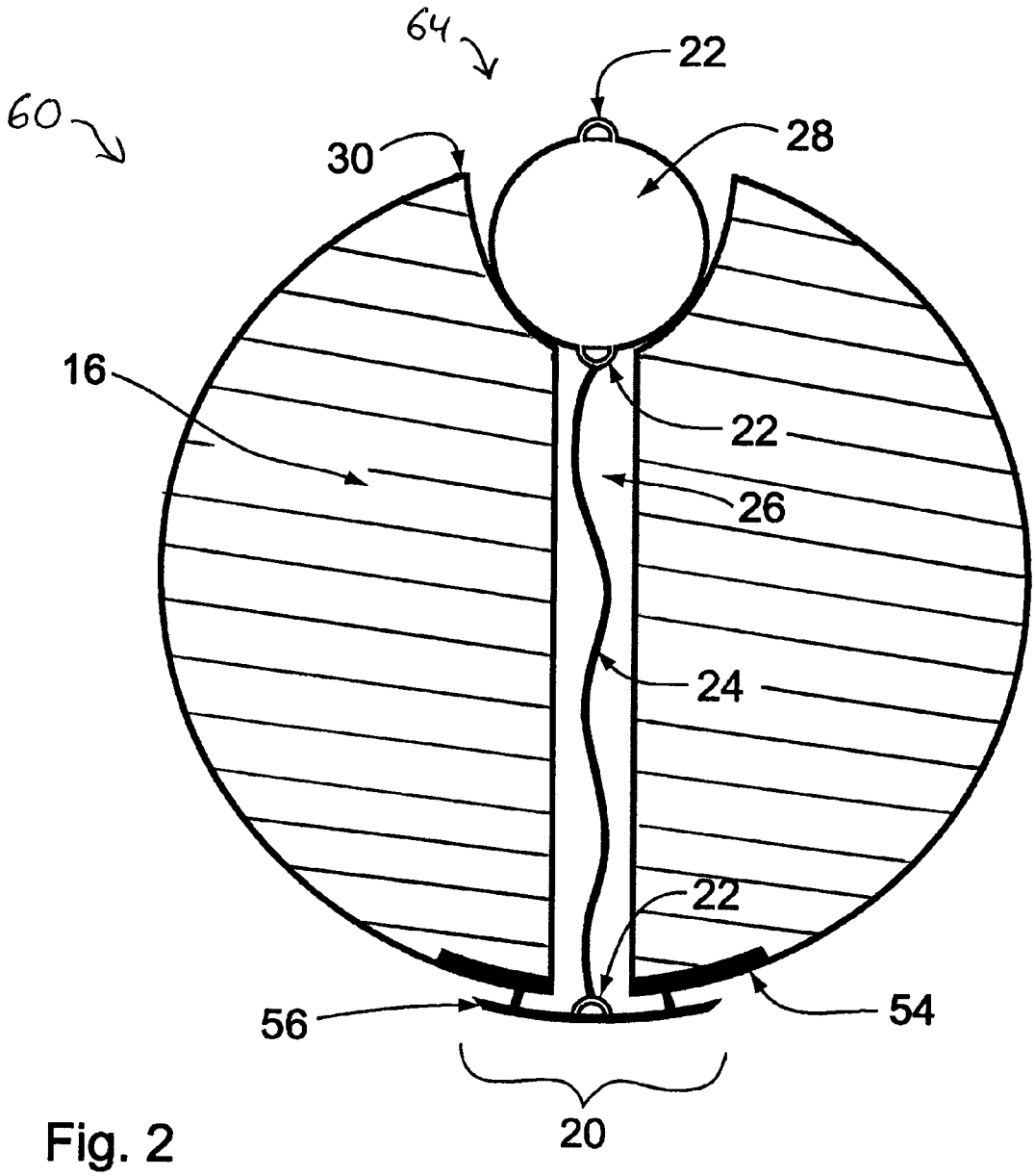
FIG. 2 is a side view, partly in cross-section and partly in elevation, of a seal and valve assembly 60.
Figure 3:
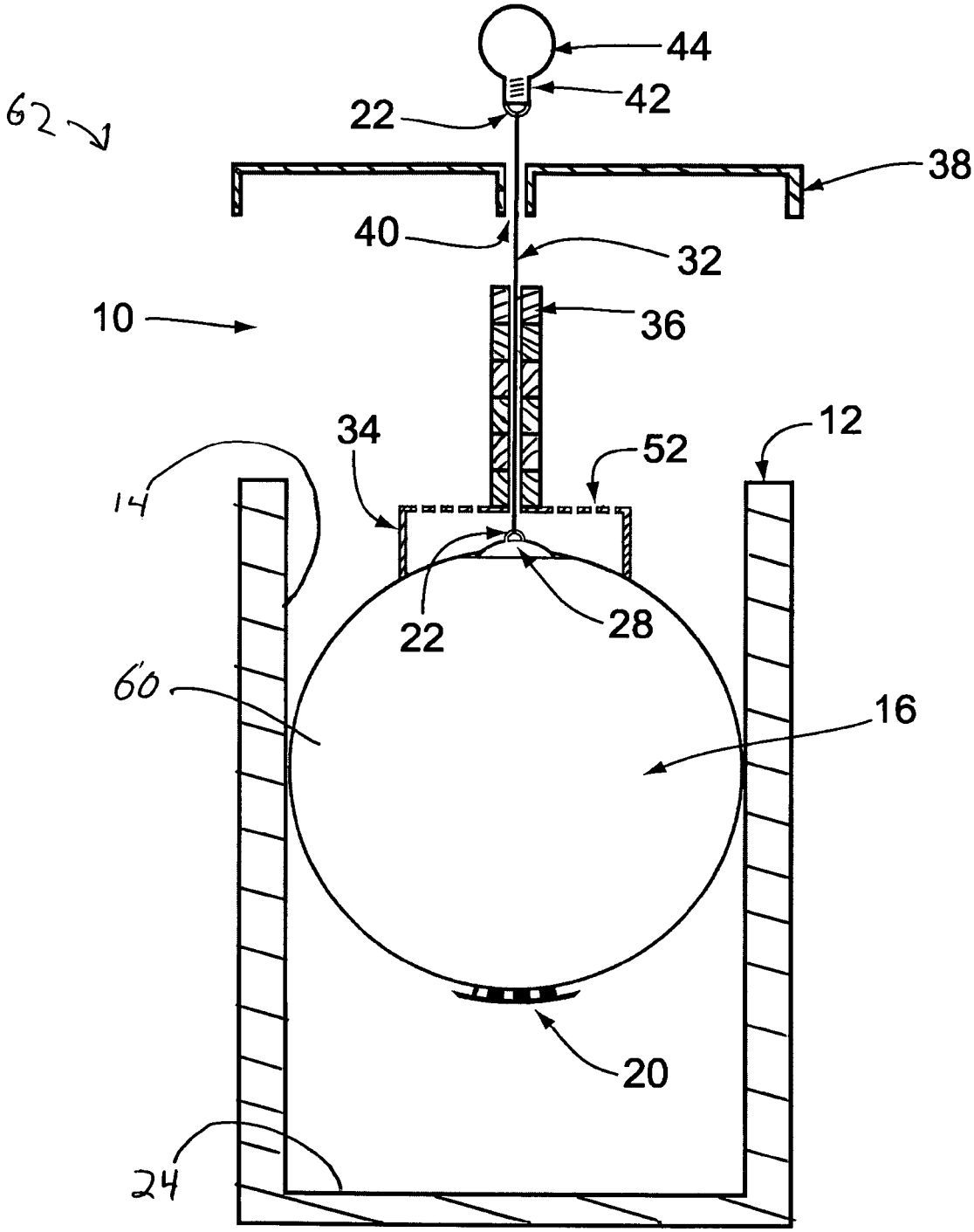
FIG. 3 is an exploded side view, partly in cross-section and partly in elevation, of the adjustable sealing device 10 and a storage container 12.
Figure 5:
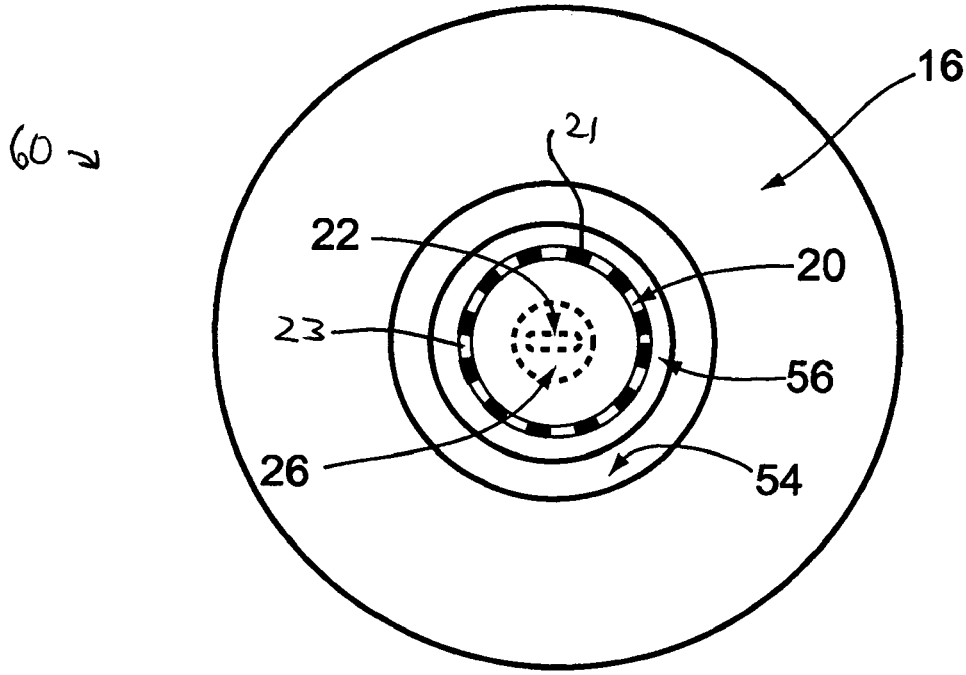
FIG. 5 is a bottom elevational view thereof, with the vent 20's cap 56 broken away.

Regarding the vent 20, by way of example, as best seen in FIGS. 2, 3 and 5, it may comprise any suitable vent conduit 26 passing through the sealing ball 16, any suitable vent flange 54, any suitable vent cap 56, and any suitable vent holes 23 formed between any suitable vent legs 21 that are located between the vent cap 56 and the vent flange 54. The vent flange 54, cap 56 and legs 21 may be integrally formed as one piece, or may be formed as one or more separate pieces which may then be assembled together in any suitable way. All or part of the vent 20 may be removed from the sealing ball 16 for cleaning of the vent 20.

The vent flange 54, vent cap 56 and vent legs 21 may be permanently or removably secured to the sealing ball 16 in any suitable way, such as by use of a tensioner 24.

As an alternative, the vent flange 54 may be eliminated so that the vent legs 21 may be carried directly by the sealing ball 16.

As best seen in FIGS. 2 and 3, the vent cap 56 may have a convex configuration that at least generally conforms to the configuration of the adjacent portion of the outer surface of the sealing ball 16, so that if the sealing ball 16 is used to tamp the coffee 18, the vent cap 56 may compress the coffee 18 in at least substantially the same manner as the rest of the sealing ball 16.

As a further alternative, both the vent flange 54 and vent legs 21 may be eliminated, and the vent cap 56 may be provided with at least one vent hole 23 that is in communication with the vent conduit 26. Such a vent cap 56 may then be removably or permanently secured to the sealing ball 16 in any suitable way, such as by use of the tensioner 24. Removably securing such a vent cap 56 to the sealing ball 16 may be preferred to make it easier to clean the vent cap 56 and vent conduit 26.

Figure 4:
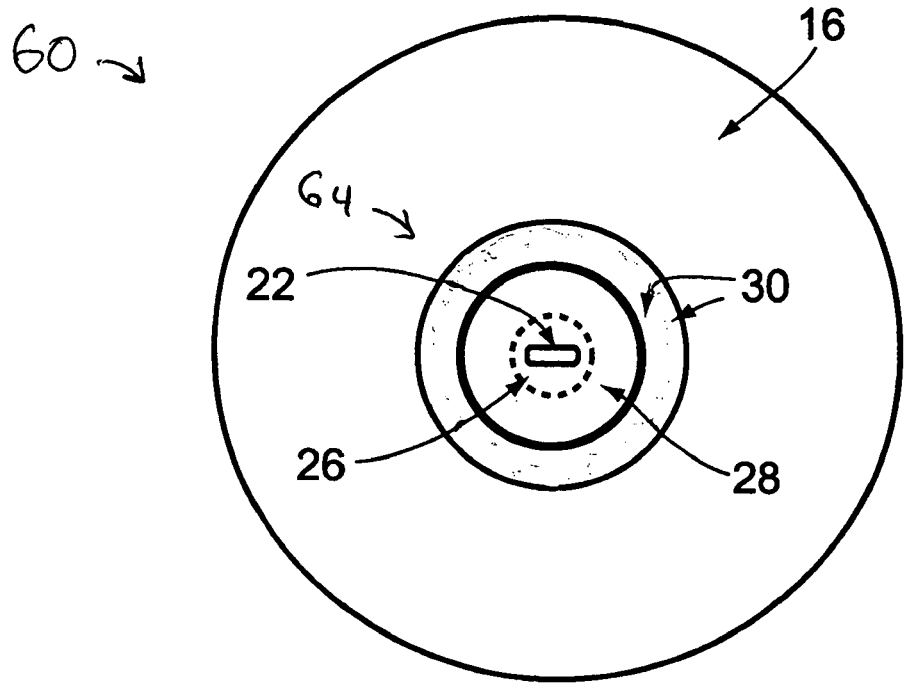
FIG. 4 is a top elevational view of the seal and valve assembly 60.

Turning now to the valve 64, as best seen in FIGS. 2-4 it may comprise, for example, any suitable valve seat 30, any suitable valve ball 28, any suitable tensioner 24, and a pair of any suitable anchors 22 for the tensioner 24. The valve 64 may, or may not, be part of the sealing ball 16.

As seen, the valve seat 30 may be formed in the top surface of the sealing ball 16. Alternatively, the valve seat 30 may be a separate element that is located partially or wholly within the sealing ball 16 or exterior to the sealing ball 16.

The tensioner 24 may comprise any suitable device for applying a tension to the valve ball 28, such as a spring or an elastic cord, in order to releasably hold the valve ball 28 in its valve seat 30.

Although the tensioner 24 is shown in FIG. 2 as being loose, in order to illustrate that it may be flexible, in actuality the tensioner 24 would be taut when it is holding the valve ball 28 against its valve seat 30 over the vent conduit 26, and when it is moved away from its valve seat 30, such as when the user tugs on the lead 32.

As seen in the Figures, the valve ball 26 and the vent cap 56 may each be provided with an anchor 22 for the tensioner 24. However, as an alternative, one or both of the anchors 22 may be eliminated, such as if one or both of the respective ends of the tensioner 24 were secured directly to the valve ball 28 or to the valve cap 56. As a further alternative, the anchor 22 that secures the lower end of the tensioner 24 may be secured in any other suitable location in the adjustable sealing device 10, such as to the interior of the vent conduit 26 or to the exterior of the sealing ball 16.

When the adjustable sealing device 10 is being inserted into the storage container 12 by the user, the tensioner 24 may permit the valve ball 28 to be lifted off from its valve seat 30 by the user tugging on the lead 32, or by the air that is compressed in the space between the descending sealing ball 16 and the bottom 24 of the container 12, to permit the compressed air to flow out of the storage container 12 through the vent 20.

When the adjustable sealing device 10 has been placed in its desired location in the storage container 12 and the user has released the lead 32, such as seen in FIG. 7, the tensioner 24 may hold the valve ball 28 in place in its valve seat 30 over the vent conduit 26 so that external air is not permitted to flow into the space between the sealing ball 16 and the bottom 24 of the storage container 12 through the vent 20, and so that volatile components of the coffee 18 are not permitted to flow out of that space through the vent 20.

When the adjustable sealing device 10 is being removed from the storage container 12, such as seen in FIG. 8, the tensioner 24 may permit the user to selectively lift the valve ball 28 away from its valve seat 30 by tugging on the lead 32, to permit external air to enter the space between the rising sealing ball 16 and the bottom 24 of the storage container 12 through the vent 20. The tensioner 24 may be relatively robust, so that it is strong enough to lift the sealing ball 16 and other components of the adjustable sealing device 10 out of the storage container 12 when the user tugs on the lead 32.

As an alternative, any other suitable valve 64 may be used in lieu of the valve 64 that is illustrated in the Figures. Any suitable valve 64 may be any valve which may be automatically or manually closed when it is desired to prevent air from entering the space between the sealing ball 16 and the bottom 24 of the storage container 12 through the vent 20, or to prevent the escape of volatile components of the coffee 18 through the vent 20; and which may be automatically or manually opened when it is desired to permit air to either leave or enter the space between the sealing ball 16 and the bottom 24 of the storage container 12, such as when the sealing ball 16 is being inserted into, or removed from, the storage container 12.

As best seen in FIGS. 3 and 6-8 the adjustable sealing device 10's insertion/removal assembly 62 may comprise any suitable knob 44, any suitable lid 38 for the storage container 12, any suitable lead 32, at least one of any suitable compression washer 36, and a compressor 34.

The lid 38 may comprise any suitable hole 40 that is sized and shaped to be operable to receive the shank 42 of the knob 44. The knob 44 and lid 38 may be releasably secured together in any suitable way, such as providing a threaded connection or a friction fit between the knob 44's shank 42 and the lid 38's hole 40. Alternatively, the knob 44 may not have a shank 42 and the lid 38 may not have a hole 40. In such an event, the knob 44 may be releasably secured to the lid 38 in any suitable way, such as by providing the lid 38 with a raised boss that engages the knob 44 in any suitable way, such as with a threaded connection or with a friction fit.

As seen, the lid 38 may be sized and shaped so as to be operable to removably cover the top of the storage container 12.

The lead 32 may be either flexible or stiff, and may be made from any suitable material, such as any suitable wire or braided material. As best seen in FIG. 3, an anchor 22 may be provided on the knob 44's shank 42 for the upper end of the end of the lead 32, and an anchor 22 may be provided on the upper surface of the valve ball 28 for the lower end of the lead 32. Alternatively, one or both of such anchors 22 may be eliminated, and the corresponding end of the lead 32 may be secured in any other suitable location, such as directly to the knob 44's shank 42 or to the upper surface of the valve ball 28.

One or more compression washers 36 may be provided through which the lead 32 passes. The combined axial length of the compression washers 36 may be selected such that when the insertion/removal assembly 62 is used in the manner that will be described, it is operable to force the sealing ball 16 at least part way down towards the bottom 24 of the storage container 32. Alternatively, the combined axial length may be selected so that the insertion/removal assembly 62 is operable to force the sealing ball 16 down so that it at least substantially reaches the bottom 24 of the storage container 12.

Any suitable compressor 34 may be used, such as that illustrated and described herein, which may have a hole through which the lead 32 may pass. The compressor 34 may be provided with vent ports 52, may be releasably secured to the sealing ball 16 in any suitable way, and may be permanently secured to the sealing ball 16 in any suitable way, such as by gluing or with a friction fit.

As an alternative, the vent ports 52 may be eliminated, in which case air may enter or leave the space between the sealing ball 16 and the bottom 24 of the container 12 through the vent 20, the hole in the compressor 34 for the lead 32, and through the central openings of the compression washers 36. As a further alternative, the compressor 34 may be eliminated, in which event at least the bottom compressor washer 36 may be suitably sized and shaped so as to be operable to bear directly against the top portion of the valve ball 28, or against the outer surface of the sealing ball 16.

Turning now to the operation of the adjustable sealing device 10, FIG. 6 illustrates it being inserted into a container 12 that is partially filled with coffee 18. In order to insert the adjustable sealing device 10 into the container 10, the user may first release the knob 44 from its hole 40 in the lid 38, and may then pull the knob 44 up so that the lead 32 unseats the valve ball 28 from its valve seat 30, and urges the sealing ball 16 up towards the lid 38.

As this is done, the taut lead 32 aligns the compression washers 36 on top of each other to form a vertical column of compression washers 36, so that the longitudinal axes of the compression washers 36 are aligned with the taut lead 32, and so that their longitudinal axes are oriented at least generally perpendicular to the lid 38 and the sealing ball 16, as seen in FIGS. 3 and 6. The vertical column of compression washers 36 is trapped between the top of the compressor 34 and the inside of the lid 38.

At this time the user may then urge the sealing ball 16 down into the storage container 12 by pushing down on the lid 38, which then pushes down on the column of compression washers 36, which then push down on the compressor 34, which then pushes down on the sealing ball 16.

As the sealing ball 16 is urged down into the storage container 12, a seal is formed between a sealing portion of its outer surface and a corresponding part of the inner surface 14 of the container 12. The descending sealing ball 16 compresses the air in the space between it and the bottom 24 of the container 12, due to the seal between its peripheral sealing portion and the corresponding portion of the inner surface 14 of the container 12.

The compressed air is allowed to escape sequentially through the vent 20's vent holes 23 and vent conduit 26, around the unseated valve ball 28, and out into the atmosphere through the vent ports 52 in the compressor 34, the hole in the compressor 34 through which the lead 32 passes, and the central openings of the compression washers 36.

The sealing ball 16 may then be further urged into the container 12, as much as is desired by the user, even to the point that essentially all of the air in the space between the sealing ball 16 and the layer of coffee 18 has been expelled from the container 12, and until the sealing ball 16 has tamped or compressed the layer of coffee 18 to help remove any air from within the coffee 18.

At this time the user may then release the knob 44 so that the lead 32 (which may be flexible) may go slack, thereby allowing the lead 32 and at least one of the compression washers 36 to drape themselves on top of the sealing ball 16, as seen in FIG. 7, so the longitudinal axis of each draped compression washer 36 is not oriented at least generally perpendicular to the lid 38 and sealing ball 16. The container 12 may be shaken or tipped to assist the lead 32 and at least one compression washer 36 in draping themselves over the sealing ball 16. Alternatively, one or more of the compression washers 36 may still be oriented perpendicular to the lid 38 and sealing ball 16 after the lead 32 has been permitted to go slack and the lid 38 has been replaced on the container 12.

Simultaneously, this release of the knob 44 and the lead 32 enables the tensioner 24 to pull the valve ball 28 back into contact with its valve seat 30, thereby sealing the vent 20 to prevent the entry of external air back into the space between the sealing ball 16 and the bottom 24 of the container 12, and to prevent the escape of volatile components of the coffee 18. The seal between the sealing ball 16 and the inside of the container 12 may serve the triple purposes of: (a) keeping external air from reaching the coffee 18; (b) keeping volatile components of the coffee 18 from escaping into the atmosphere; and (c) holding the sealing ball 16 in place inside of the container 12. The lid 38 may then be replaced on the container 12, and the knob 44 may then be secured by the user back in its hole 40 in the lid 38.

Referring now to FIG. 8, in order to remove the adjustable sealing device 10 from the container 12 so that the user may have access to the coffee 18, the user may lift the lid 38 by its knob 44 until the lead 32 raises the valve ball 28 and unseats it from its valve seat 30. At this point the tension exerted on the valve ball 28 by the lead 32 starts to raise the sealing ball 16 out of the container 12 because the lifting force exerted by the lead 32 on the valve ball 28 is transmitted to the sealing ball 16 via the tensioner 24 which is connected to the vent 20 which is, in turn, connected to the sealing ball 16.

As the sealing ball is raised in the container 12, air enters the space between the sealing ball 16 and bottom 24 of the container 12 through the ports 52 in the compressor 34, through the hole in the compressor 34 for the lead 32, through the hollow centers of the compression washers 36, and through the vent 20. This enables the pressure of the air in the space between the sealing ball 16 and the bottom 24 of the container 12 to be equalized with the ambient external air pressure, meaning that the sealing ball 16 is only being held in the storage container 12 by the compression of the peripheral sealing portion of the sealing ball 16 against the corresponding portion of the inner surface 14 of the container 12. By continuing to pull on the knob 44, the adjustable sealing device 10 may be easily and completely removed from the storage container 12.

The various components of the adjustable sealing device 10 may be made from any suitable materials that are consistent with food safety and the operational needs of the components.

The adjustable sealing device 10 may further comprise any suitable oxygen or moisture scavenging chemicals that may be housed in any suitable location in the adjustable sealing device 10, such as in its vent conduit 26 or impregnated into the outer surface of the sealing ball 16.

It is to be understood that, without departing from the scope and spirit of the claimed invention, any particular part of any of the adjustable sealing device 10 may be suitably combined or formed with one or more of its other the other parts to form one integral or composite part; that any particular part of the adjustable sealing device 10 that may be made in one piece may instead be made by assembling together in any suitable way, two or more sub-pieces; and that the various parts of adjustable sealing device 10 may be assembled together in any suitable ways other than those described herein, such by using fasteners; interference fits, friction fits; barbed, threaded, bonded, glued or welded connections; splines; keys; or mechanical couplers.

It is also to be understood that the specific embodiments of the claimed invention that are disclosed herein were disclosed strictly by way of non-limiting example. Accordingly, various modifications may be made to those embodiments without deviating from the scope and spirit of the claimed invention. Additionally, certain aspects of the claimed invention that were described in the context of a particular embodiment may be combined or eliminated in other embodiments. Although advantages associated with a certain embodiment of the claimed invention have been described in the context of that embodiment, other of the embodiments may also exhibit such advantages. Further, not all embodiments need necessarily exhibit any or all of such advantages in order to fall within the scope of the claimed invention.

Before an element in a claim is construed as claiming a means for performing a specified function under 35 USC section 112, last paragraph, the words "means for" must be used in conjunction with that element.

As used herein, except in the claims, the words "and" and "or" are each defined to also carry the meaning of "and/or".

In view of all of the disclosures herein, these and further modifications, adaptations and variations of the claimed invention will now be apparent to those of ordinary skill in the art to which it pertains, within the scope of the following claims.

What is claimed is:

1. An adjustable sealing device for a storage container having a bottom, an opening, and an at least substantially cylindrical sidewall that expands upwardly from said bottom to said opening; wherein said at least substantially cylindrical sidewall comprises an inner surface, an inner size and an inner cross-sectional configuration; and wherein said sealing device comprises:

a seal and valve assembly; and an insertion/removal assembly for said seal and valve assembly;

wherein said insertion/removal assembly is operable to permit a user to insert said seal and valve assembly into said storage container and to remove said seal and valve assembly from said storage container;

wherein said seal and valve assembly comprises a sealing ball, a vent in said sealing ball, and a valve for said vent;

wherein at least a peripheral sealing portion of said sealing ball is resilient; wherein said peripheral sealing portion is sized and shaped to be operable to form a seal with a corresponding portion of said inner surface of said at least substantially cylindrical sidewall; and wherein said valve is operable to permit air to escape through said vent from a space between said sealing ball and said bottom of said storage container when said seal and valve assembly is inserted into said storage container, is operable to permit air to enter said space through said vent when said seal and valve assembly is removed from said storage container, and is operable to prevent air from entering said space through said vent when said seal and valve assembly is installed in a desired location within said storage container.

2. The adjustable sealing device according to claim 1, wherein said peripheral sealing portion of said sealing ball has an uncompressed size; and wherein said uncompressed size is larger than said inner size of said at least substantially cylindrical sidewall is located below said opening.

3. The adjustable sealing device according to claim 2, wherein said inner size of said at least substantially cylindrical sidewall of said storage container falls in the range of from about 90% to about 99% of said uncompressed size of said peripheral sealing portion of said sealing ball.

4. The adjustable sealing device according to claim 2, wherein said inner size of said at least substantially cylindrical sidewall of said storage container falls in the range of from about 80% to about 89% of said uncompressed size of said peripheral sealing portion of said sealing ball.

5. The adjustable sealing device according to claim 2, wherein said inner size of said at least substantially cylindrical sidewall of said storage container falls in the range of from about 70% to about 79% of said uncompressed size of said peripheral sealing portion of said sealing ball.

6. The adjustable sealing device according to claim 2, wherein said inner size of said at least substantially cylindrical sidewall of said storage container falls in the range of from about 60% to about 69% of said uncompressed size of said peripheral sealing portion of said sealing ball.

7. The adjustable sealing device according to claim 2, wherein said inner size of said at least substantially cylindrical sidewall of said storage container falls in the range of from about 50% to about 59% of said uncompressed size of said peripheral sealing portion of said sealing ball.

8. The adjustable sealing device according to claim 1, wherein when said peripheral sealing portion of said sealing ball is uncompressed, said peripheral sealing portion has a cross-sectional configuration that is different from said inner cross-sectional configuration of said at least substantially cylindrical sidewall of said storage container.

9. An adjustable sealing device for a storage container having a bottom, an inner surface, an inner size and an inner cross-sectional configuration; wherein said sealing device comprises:

a seal and valve assembly; and an insertion/removal assembly for said seal and valve assembly;

wherein said insertion/removal assembly is operable to permit a user to insert said seal and valve assembly into said storage container and to remove said seal and valve assembly from said storage container;

wherein said seal and valve assembly comprises a sealing ball, a vent in said sealing ball, and a valve for said vent;

wherein at least a peripheral sealing portion of said sealing ball is resilient; wherein said peripheral sealing portion is sized and shaped to be operable to form a seal with a corresponding portion of said inner surface of said storage container;

wherein said valve is operable to permit air to escape through said vent from a space between said sealing ball and said bottom of said storage container when said seal and valve assembly is inserted into said storage container, is operable to permit air to enter said space through said vent when said seal and valve assembly is removed from said storage container, and is operable to prevent air from entering said space through said vent when said seal and valve assembly is installed in a desired location within said storage container;

wherein said valve comprises a valve ball, a valve seat, and a tensioner that is operable to apply a tension to said valve ball to releasably hold said valve ball against said valve seat; and wherein when said valve ball is held against said valve seat said valve is operable prevent air from entering said space between said sealing ball and said bottom of said storage container through said vent when said seal and valve assembly is installed in a desired location within said storage container.

10. The adjustable sealing device according to claim 9, wherein said insertion/removal assembly comprises a lead that is connected to said valve ball; and wherein said lead is selectively operable to urge said valve ball away from said valve seat to permit air to escape from said space between said sealing ball and said bottom of said storage container through said vent when said seal and valve assembly is inserted into said storage container, and to permit air to enter said space through said vent when said seal and valve assembly is removed from said storage container.

11. The adjustable sealing device according to claim 10, wherein said lead is further selectively operable to urge said seal and valve assembly out of said storage container.

12. The adjustable sealing device according to claim 10, wherein said insertion/removal assembly further comprises at least one compression washer and a lid for said storage container;

wherein said lead is flexible; wherein said at least one compression washer has a longitudinal axis;

wherein said lid comprises a hole;

wherein said lead passes through said hole in said lid and through said at least one compression washer; wherein said at least one compression washer is located between said lid and said sealing ball;

wherein, when a tension is applied to said lead, said lead is operable to orient said longitudinal axis of said at least one compression washer at least generally perpendicular to said lid and to said sealing ball, to enable said lid to be operable to urge said seal and ball assembly into said storage container by a pressure exerted by a user on said lid, which in turn exerts a pressure on said at least one compression washer, which in turn exerts a pressure on said sealing ball; and wherein, when said seal and valve assembly has been urged into said storage container a desired amount said tension is removed from said lead, to enable said lid to be placed on said storage container, and to enable said lead and at least one said compression washer to be operable to compactly drape over an upper surface of said sealing ball between said sealing ball and said lid on said storage container, with said longitudinal axis of at least one said compression washer not being oriented at least generally perpendicular to said lid and to said sealing ball.

13. The adjustable sealing device according to claim 12, wherein said insertion/removal assembly further comprises a compressor located between said at least one compression washer and said sealing ball.

14. The adjustable sealing device according to claim 1, wherein said insertion/removal assembly comprises a lead, at least one compression washer, and a lid for said storage container;

wherein said lead is flexible; wherein said at least one compression washer has a longitudinal axis;

wherein said lid comprises a hole;

wherein said lead passes through said hole in said lid and passes through said at least one compression washer; wherein said at least one compression washer is located between said lid and said sealing ball;

wherein, when a tension is applied to said lead, said lead is operable to orient said longitudinal axis of said at least one compression washer at least generally perpendicular to said lid and to said sealing ball, to enable said lid to be operable to urge said seal and ball assembly into said storage container by a pressure exerted by a user on said lid, which in turn exerts a pressure on at least one said compression washer, which in turn exerts a pressure on said sealing ball; and wherein, when said seal and valve assembly has been urged into said storage container a desired amount said tension is removed from said lead, to enable said lid to be placed on said storage container, and to enable said lead and at least one said compression washer to be operable to compactly drape over an upper surface of said sealing ball between said sealing ball and said lid on said storage container, with said longitudinal axis of at least one said compression washer not being oriented at least generally perpendicular to said lid and to said sealing ball.

15. The adjustable sealing device according to claim 14, wherein said insertion/removal assembly further comprises a compressor located between said at least one compression washer and said sealing ball.

16. The adjustable sealing device according to claim 14, wherein said lead is selectively operable to urge said seal and valve assembly out of said storage container.

* * * * *